US009609937B1

(12) United States Patent
King

(10) Patent No.: US 9,609,937 B1
(45) Date of Patent: Apr. 4, 2017

(54) EYE LID PROTECTOR AND EYE MAKE-UP PROTECTOR

(71) Applicant: Debra August King, New York, NY (US)

(72) Inventor: Debra August King, New York, NY (US)

(73) Assignee: Debra August King, New York, NY (US)

( * ) Notice: Subject to any disclaimer, the term of this patent is extended or adjusted under 35 U.S.C. 154(b) by 170 days.

(21) Appl. No.: 14/149,559

(22) Filed: Jan. 7, 2014

Related U.S. Application Data

(60) Provisional application No. 61/750,162, filed on Jan. 8, 2013.

(51) Int. Cl.
*A45D 40/30* (2006.01)

(52) U.S. Cl.
CPC ..... *A45D 40/30* (2013.01)

(58) Field of Classification Search
CPC ..... A45D 40/30; A45D 44/12; A45D 44/002; A45D 2200/1009; A45D 2200/1018; A45D 2200/1027; A45D 24/36
USPC ..... 132/319, 200, 212, 213, 214, 216, 320, 132/285, 333, 217; D28/7, 30, 9, 99; 2/15, 11, 9, 173, 174, 206; D29/106, 108; D21/659, 660; 118/506
See application file for complete search history.

(56) References Cited

U.S. PATENT DOCUMENTS

| | | | | | |
|---|---|---|---|---|---|
| 1,907,476 | A * | 5/1933 | Ballard et al. | 132/216 |
| 3,772,707 | A * | 11/1973 | Alosi et al. | 2/174 |
| D244,880 | S * | 6/1977 | Terry | D29/108 |
| 4,118,870 | A * | 10/1978 | Dyson | 33/512 |
| D268,877 | S * | 5/1983 | Loewenstine | D28/9 |
| 4,807,650 | A * | 2/1989 | Bliss | 132/319 |
| 5,016,658 | A * | 5/1991 | Green | 132/216 |
| 5,050,624 | A * | 9/1991 | Kobe et al. | 132/319 |
| 5,052,417 | A * | 10/1991 | Cordova | 132/216 |
| 5,097,598 | A * | 3/1992 | Andreula | 30/233 |
| 5,178,170 | A * | 1/1993 | Kassai | 132/319 |
| 5,311,888 | A * | 5/1994 | Leigh | 132/319 |
| D388,907 | S * | 1/1998 | Brueckner | D29/108 |
| 5,890,499 | A * | 4/1999 | Fuentes et al. | 132/319 |
| 5,957,142 | A * | 9/1999 | Karafilis | 132/319 |
| 6,199,560 | B1 * | 3/2001 | North et al. | 132/319 |
| 6,640,814 | B1 * | 11/2003 | Burke | 132/319 |
| 8,684,013 | B2 * | 4/2014 | Haman et al. | 132/319 |
| 2004/0089319 | A1 * | 5/2004 | Thayer | 132/319 |
| 2005/0022838 | A1 * | 2/2005 | Davis | 132/319 |
| 2006/0225761 | A1 * | 10/2006 | Secosky | 132/218 |
| 2007/0163613 | A1 * | 7/2007 | Lee | 132/216 |
| 2009/0183747 | A1 * | 7/2009 | Salicunaj | 132/200 |
| 2010/0018545 | A1 * | 1/2010 | Franklin et al. | 132/319 |
| 2011/0100392 | A1 * | 5/2011 | Smith et al. | 132/320 |
| 2013/0025613 | A1 * | 1/2013 | Branch | 132/200 |
| 2013/0146076 | A1 * | 6/2013 | Dunaway | 132/200 |
| 2014/0069448 | A1 * | 3/2014 | Forsythe et al. | 132/200 |

* cited by examiner

*Primary Examiner* — Rachel Steitz
(74) *Attorney, Agent, or Firm* — Leason Ellis LLP

(57) ABSTRACT

The invention provides a tool and method of use thereof for preventing the inadvertent transfer of mascara or other eyelash substance to the eye lid during application of the mascara or substance to the eyelashes.

11 Claims, 2 Drawing Sheets

FIG. 1
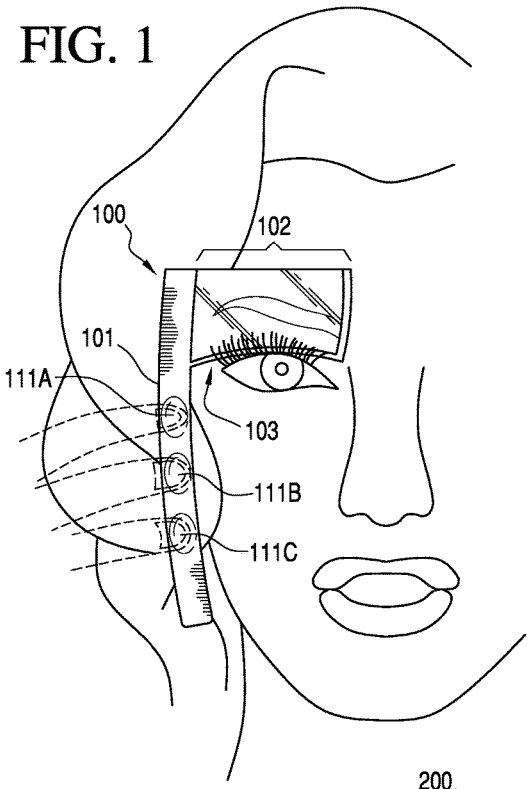
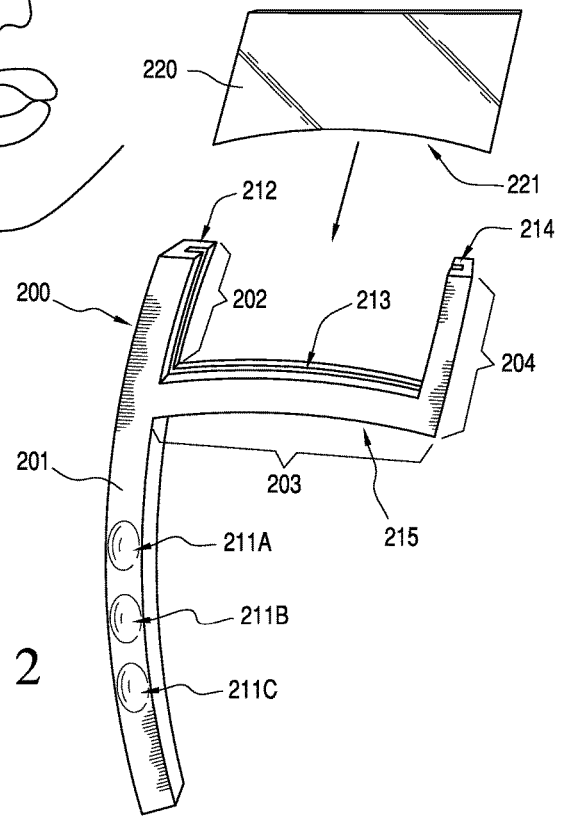
FIG. 2

EYE LID PROTECTOR AND EYE MAKE-UP PROTECTOR

CROSS-REFERENCE TO RELATED APPLICATIONS

This application claims the benefit of U.S. provisional application Ser. No. 61/750,162 filed Jan. 8, 2013, which is hereby incorporated by reference in its entirety.

FIELD OF THE INVENTION

The invention relates to the field of cosmetics.

BACKGROUND OF THE INVENTION

During the application of mascara or any type of eyelash substance to the eyelashes, the material can be inadvertently transferred to one's eyelid, whether the eyelid has eye shadow, eye make-up, or is bare. Once the mascara or other substance transfers to the eye lid, removal is required for aesthetic purposes. This removal can disrupt existing eye shadow, necessitating that the eye shadow be reapplied. Even transfer to a bare eye lid will require another substance/material (soap, water, eye make removal fluid) to be used, wasting time, energy and resources.

What is needed and provided by the present invention is a tool and method of use thereof for preventing the inadvertent transfer of mascara or lash substance to the eyelid during application of the mascara or lash substance.

SUMMARY OF THE INVENTION

One embodiment of the invention provides a make-up tool for preventing the inadvertent transfer of mascara to an eyelid that includes:

an elongated handle portion having a top and a bottom; and an expansive banner portion attached to (such as integral with) and extending laterally from the elongated handle portion at or near the top thereof. The banner portion may, for example, be at least substantially quadrilateral. There may be a single banner portion such that the tool somewhat resembles a flag on a flag post or there may be two banner portions extending opposite one another away from the elongated handle portion, so that the tool overall has a T-shaped configuration. The bottom of the banner portion may have a concave curvature that follows the curvature of the eyelid when the tool is used.

A related embodiment provides a make-up tool having a front face and a back face for preventing the inadvertent transfer of mascara to an eyelid, that includes:

an elongated handle portion having a top and a bottom; and a first elongated frame segment extending laterally from the elongated handle portion at a level below the top of the elongated handle portion, wherein a continuous groove is formed between the front and back face from the top of the elongated handle portion extending down the length of the first elongated frame segment, whereby a mutually sized and configured panel of material can be removably inserted into the groove to form a banner portion of the tool. The panels used may, for example, be formed of a thick paper, a cardboard such as a laminated cardboard, or a plastic sheet. The bottom side of the first elongated frame segment may have a concave curvature and the panels used may similarly have a corresponding concave curvature.

A further embodiment provides a make-up tool having a front face and a back face for preventing the inadvertent transfer of mascara to an eyelid, that includes:

an elongated handle portion having a top and a bottom; and a first elongated frame segment extending laterally from the elongated handle portion at a level at or near the top of the elongated handle portion, the segment having a bottom side with a lateral groove formed therein between the front face and back face thereof, whereby a mutually sized and configured panel of material can be removably inserted into the groove to form a banner portion of the tool. The bottom side (edge) of the panels used may have a concave curvature. The groove may optionally continue into the adjacent side of the handle portion extending downward from the level of the first elongated frame segment. The tool may further include the panel with the top side of the panel inserted into the groove formed in the bottom side of the first elongated frame segment. In a groove is provided in the handle portion as described, the adjacent lateral side of the panel may also be inserted into said groove.

Another embodiment of the invention provides a make-up tool having a front face and a back face for preventing the inadvertent transfer of mascara to an eyelid, comprising:

an elongated handle portion having a top and a bottom;

a first elongated frame segment extending laterally from the elongated handle portion, wherein a laterally extending vertically oriented groove is formed between the front face and back face of the first elongated frame segment on the top side or bottom side thereof, whereby a mutually sized and configured panel of material can be removably inserted into the groove to form a banner portion of the tool.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

FIG. 1 shows a front view of a make-up tool embodiment of the invention

FIG. 2 shows a perspective view of a different make-up tool embodiment of the invention

DETAILED DESCRIPTION OF THE INVENTION

Figure 3:
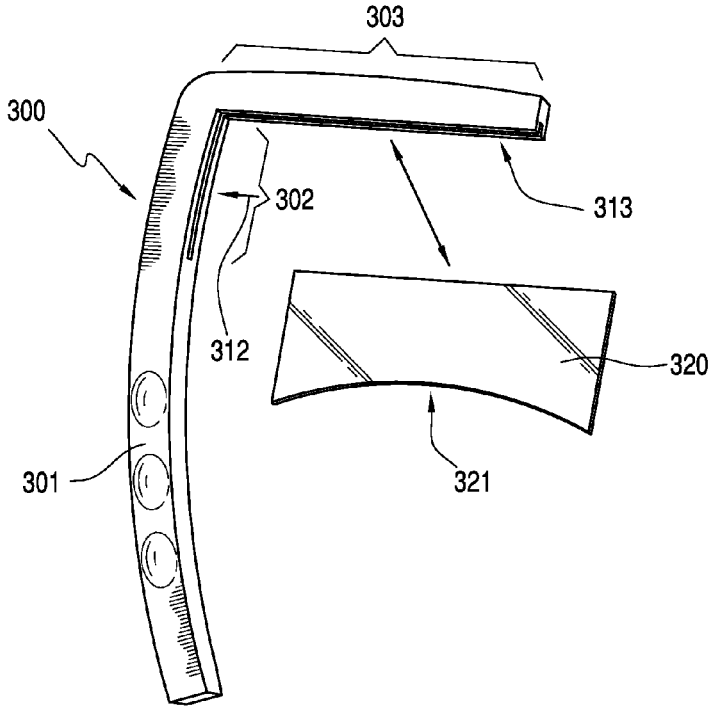
FIG. 3 shows a perspective view of still another make-up tool embodiment of the invention.

The invention provides tools and methods of use thereof for preventing the inadvertent transfer of mascara or other eyelash substance to the eye lid during application of the mascara or eyelash substance to the user's eyelashes.

To prevent contents/substances (mascara) from contacting the eye lid, the eye lid protector is held to the side of the face with the handle being positioned over the most lateral area of the face. The perpendicular aspect of the actual protector (banner portion) may, for example, be made of a clear translucent material (plastic), a thin paper material (i.e. tissue paper), mole skin, or any material that would not irritate the eye lid and is light weight.

Some of the materials used as the eye lid protector may be disposable, inter-changeable, cleansable and/or reusable. Each eye protector is used for the application of mascara or other eyelash substance to the eyelashes and can then be flipped over for use on the other eye.

The ergonomically comfortable handle allows for accurate application of eyelash mascara/substance. Having the handle on the lateral side allows for an unobstructed view of, and access to, the eyelashes for which application of a substance is performed. Finger impression indentions along the handle shaft allow for a comfortable grip.

Various aspects and features of the invention are further described herein below with respect to the appended figures.

FIG. 1 shows a make-up tool embodiment 100 of the invention, in use, that includes an elongated handle portion 101 having three "finger impression" indentations 111A-C on the front face of the handle (similar indentations may be provided on the back face of the handle portion) and a single banner portion 102 extending laterally from the top of handle portion 101. The bottom side 103 of banner portion 102 has a concave curvature which follows the curvature of the eyelid with which tool 100 is used. Handle 101 is also curved such that it has a concave curvature on the side on which banner portion 102 extends laterally, and a convex curvature on the opposite lateral side. This handle curvature advantageously provides good manual control of the tool while following facial contours and minimizing obstruction for application of the lash make-up. As shown, in use, tool 100 is held by its handle portion 101 so that banner portion 102 is disposed between the eyelashes (upper in figure) and the underlying eyelid with concave bottom side 103 juxtaposed with the rim of the corresponding eyelid. The protector shown can be used on one eye, as shown, and then flipped over to use on the other eye.

FIG. 2 shows a make-up tool embodiment 200 of the invention that includes an elongated handle portion 201 having a top and a bottom. Finger impression indentations 211A-C are formed in the front face of handle portion 201. Similar indentations may be formed on the back side. A top portion 202 of handle portion 201 has a groove 212 formed therein. Below the top of handle portion 201 a frame segment 203 laterally extends therefrom to a point at which a further frame segment 204 extends in an upward direction. As shown, groove 212 in portion 202 continues as groove 213 in segment 203 and groove 214 in segment 204. In this manner a continuous groove is formed which serves as a track for receiving a panel 220 of mutually sized and configured material. At least the bottom side 215 of frame segment 203 has a concave curvature. If groove 213 has a corresponding concave curvature (it may or may not), the bottom side 221 of panel 220 will have a matching concave curvature. Panel 220 is inserted into the groove to form, with the surrounding framing elements, the banner portion of the make-up tool. Handle 201 is also curved such that it has a concave curvature on the side on which segment 203 laterally extends, and a convex curvature on the opposite lateral side. The invention also provides similar embodiments that omit frame segment 204 completely or have a similarly disposed frame segment that extends only a short partial distance up toward the top of the tool.

FIG. 3 shows still another make-up tool embodiment 300 of the invention that includes a handle portion 301 with a frame portion 303 laterally extending therefrom. A vertically oriented, laterally extending groove 313 is formed in the bottom side of frame portion 303 and continues part way down a portion 302 of handle 300 (see groove portion 312). A panel of thin material 320 having a concave bottom side 321 is mutually sized and configured with tool 300 to be removably inserted into the groove formed therein to form the banner portion of the make-up tool.

Without limitation, the invention provides the following embodiments.

One embodiment of the invention provides a make-up tool for preventing the inadvertent transfer of mascara to an eyelid that includes:

an elongated handle portion having a top and a bottom; and an expansive banner portion attached to and extending laterally from the elongated handle portion at or near the top thereof. The banner portion may, for example, be at least substantially quadrilateral. There may be a single banner portion such that the tool somewhat resembles a flag on a flag post or there may be two banner portions extending opposite one another away from the elongated handle portion, so that the tool overall has a T-shaped configuration. The width of the banner portions may for example be in the range of 0.75 to 2.5 inches, such as in the range of 1.5 to 2.5 inches, so that it is of sufficient width to cover at least substantially all of an eyelid of the user. The expansive banner portion may (each) laterally extend 0.75 to 2.5 inches, such as 1.5 to 2.5 inches, from the elongated handle. The configuration in which the elongated handle portion is at one side of the banner portion during use of the tool is advantageous in that it provides easy and unobscured access to apply eyelash make-up when the handle is oriented toward the side of the head with the banner portion extending toward the center of the head.

The expansive banner portion may have a top edge, a bottom edge, a first side edge and a second side edge, be attached to the elongated handle portion at one of the side edges, and its bottom edge may have a concave profile. The concave profile of the bottom side is designed to follow the curvature of the user's top eyelid. The top edge of the banner portion may for example, have a convex profile, such as one at least substantially parallel to the curvature of the bottom edge, it may have a straight profile, or it may have a concave profile. When the top edge of the banner portion has a concave profile, a user can vertically reposition the tool for use with both the upper eyelashes (using the concave bottom edge of the banner portion) and the lower eyelashes (using the upper concave top edge of the banner portion) without flipping the tool over or releasing one's grip from the handle.

The make-up tool may, for example, be one-piece. It may, for example, be made of plastic, such as by injection molding or any other method known in the art. The make-up tool may be disposable or reusable.

The elongated handle portion may include a sequence of vertically arranged indentations in the manner of finger impressions, such as three impressions, to aid in gripping the tool during use. Such impressions may be formed in both the front face and back face of the handle, in one of the front face or back face of the handle or neither in the front face or back face of the handle.

A related embodiment provides a kit that includes a plurality of make-up tools as described.

A related embodiment provides a make-up tool having a front face and a back face for preventing the inadvertent transfer of mascara to an eyelid, that includes:

an elongated handle portion having a top and a bottom; and a first elongated frame segment extending laterally from the elongated handle portion at a level below the top of the elongated handle portion, wherein a continuous groove is formed between the front and back face from the top of the elongated handle portion extending down the length of the first elongated frame segment, whereby a mutually sized and configured panel of material can be removably inserted into the groove to form a banner portion of the tool. The panel may, for example, be formed of an at least substantially rigid sheet material which may nevertheless be flexible. It may, for example, be formed from a thick paper, a cardboard such as a laminated cardboard, or a plastic sheet. The panels may be made by any manner such as by cutting out the shapes from a large master sheet using a cutting die or other cutting tool.

The bottom side of the first elongated frame segment may have a concave curvature. In this manner, the banner portion formed by inserting a panel into the groove will have a concave bottom.

The first elongated frame segment may, for example, laterally extend 0.75 to 2.5 inches, such as 1.5 to 2.5 inches, from the elongated handle.

The make-up tool of the embodiment may further include: the mutually sized and configured panel of material removably inserted into the groove to form the banner portion of the tool. The bottom side of the banner portion so formed may have a concave curvature as described above. The top edge of the panel may, for example, have a convex curvature, such as one parallel to the concave curvature of its bottom edge, it may be straight, or it may itself have a concave curvature.

The make-up tool of the embodiment may still further include a second elongated frame segment that extends vertically upward from the end of the first elongated frame segment that is distant to the elongated handle portion, the groove continuing up the lateral side of the second elongated frame segment that faces the handle portion and opening at the top of the second elongated frame segment, whereby a mutually sized and configured panel of material can be removably inserted into the groove to form a banner portion of the tool. Thus, the tool may provide three grooved sides to receive and support the mutually sized and configured panel of material.

A further embodiment of the invention provides a make-up tool having a front face and a back face for preventing the inadvertent transfer of mascara to an eyelid, that includes:

an elongated handle portion having a top and a bottom; and a first elongated frame segment extending laterally from the elongated handle portion at a level at or near the top of the elongated handle portion, the segment having a bottom side with a lateral groove formed therein between the front face and back face thereof, whereby a mutually sized and configured panel of material can be removably inserted into the groove to form a banner portion of the tool. Thus, the tool may have an inverted-L configuration. The bottom side (edge) of the panels used may have a concave curvature. The groove may optionally continue into the adjacent side of the handle portion extending downward from the level of the first elongated frame segment. A related variation provides the tool with the panel removably inserted in the groove therein to form the banner portion.

The invention also provides a kit that includes:

at least one make-up tool as described above that is configured to receive a panel into the groove formed therein; and a plurality of panels of material mutually sized and configured with the tool to be removably inserted into the groove thereof to form a banner portion of the tool.

The invention also provides embodiments in which banner portion panels are adhesively, such as reversibly adhesively, attached to a reusable make-up tool having a handle portion and one or more frame segments as described above with or without the groove formed therein. In this case, the banner portion panels may be provided with an adhesive on at least one side along the periphery of the panel with the panel then being stuck to the front (or back) face of the tool (to the frame segment(s) and optionally the laterally adjacent handle portion) to form the banner portion thereof. Such panels may be provided in a peel-and-stick configuration, as known in the art, in which a film is peeled off the panel to reveal an adhesive layer.

Embodiments of the invention configured to employ disposable panels are advantageous in that mascara or other eyelash substance make-up tends to accumulate on the banner portion of the tools during repeated use and this can interfere with make-up application and become messy.

In any of the embodiments of the invention in which there is a single banner portion, such as those shown in the figures, the elongated handle portion may have a concave curvature on the side from which the banner portion extends and a convex curvature on its laterally opposite side. In any of the embodiments of the invention the elongated handle portion (including the part from which the banner portion extends) may, for example, have a height of 2.0 to 5.0 inches, such as 3.0 to 4.5 inches, for example, 4.0 to 4.5 inches. The height of the banner portion alone may, for example, be in the range of 0.5 to 1.5 inches, such as in the range of 0.75 to 1.0 inches. The front-to-back thickness of the handle portion may, for example, be in the range of 0.125 to 0.25 inches thick.

Still another embodiment of the invention provides a method for preventing the transfer of eyelash make-up to the eye lid during application of the make-up to the top eyelashes, that includes the steps of:

while holding a make-up tool as described herein by its handle, disposing the banner portion of the tool between the eyelashes of an eye (such as the top eyelashes) and the underlying eyelid (the eyelid attached to the eyelashes); and applying the eyelash make-up to the eyelashes of the eye while the tool is disposed between the eyelashes and the eyelid.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit on the invention. Moreover, as is readily apparent, numerous modifications and changes readily occur to those skilled in the art. Hence, it is not desired to limit the invention to the exact construction and operations shown and described and, accordingly all suitable modifications equivalents may be resorted to falling within the scope of the invention as claimed. It is the intention, therefore, to be limited only as indicated by the scope of the claims appended hereto.

What is claimed is:

1. A make-up tool having a front face and a back face for use with a panel of material for preventing the inadvertent transfer of mascara to an eyelid, comprising:

an elongated handle portion having a top, a bottom and a side;

a first elongated frame segment extending laterally from the side of the elongated handle portion, the first elongated frame segment having a top side, a bottom side, a front face and a back face, the first elongated frame segment being disposed below the top of the handle portion, a second elongated frame segment that extends vertically upward from the end of the first elongated frame segment that is distant to the elongated handle portion, a laterally extending vertically groove formed in the top side of the first elongated frame segment between the front face and back face of the first elongated frame segment on the top side or bottom side thereof, the groove continuing up the lateral side of the second elongated frame segment that faces the handle portion and opening at the top of the second elongated frame segment and sized and configured to removably receive the panel of material.

2. The make-up tool of claim 1, wherein the bottom side of the first elongated frame segment has a concave curvature.

3. The make-up tool of claim 1, wherein the first elongated frame segment laterally extends 0.75 to 2.5 inches from the elongated handle portion.

4. The make-up tool of claim 1, further comprising:

the panel of material removably inserted into the groove to form a banner portion of the tool.

5. The make-up tool of claim 4, wherein:

the banner portion extends laterally from the side of the elongated handle portion at or near the top thereof, the elongated handle portion and banner portion being substantially orthogonal.

6. The make-up tool of claim 4, wherein the banner portion includes fabric.

7. The make-up tool of claim 4, wherein:

the panel of material removably inserted into the groove to form the banner portion of the tool has a top edge and a bottom edge, wherein the top edge of the panel is inserted into the groove, and the bottom edge of the panel has a concave curvature.

8. A method for preventing the transfer of eyelash make-up to an eyelid of an eye during application of the make-up to eyelashes by the wearer of the make-up, the method comprising:

while holding a make-up tool according to claim 4 by the elongated handle portion laterally to the eye, along a side facial contour, disposing the banner portion of the tool between the eyelashes of the eye and the eyelid; and applying the eyelash make-up to the eyelashes of the eye while the tool is disposed between the eyelashes and the eyelid.

9. The method of claim 8, wherein the banner portion of the make-up tool has a bottom edge with a concave curvature and the disposing further comprises disposing the bottom edge of the banner portion adjacent to the base of the eyelashes.

10. The method of claim 8, wherein the elongated handle portion has a concave curvature on the side from which the banner portion extends, the method further comprising:

holding the tool along a side facial contour while applying the eyelash make-up, thereby providing manual control of the tool and minimizing obstruction during application of the make-up.

11. The make-up tool of claim 4, wherein the elongated handle portion has a concave curvature on the side from which the banner portion extends.

* * * * *